US006794008B2

(12) United States Patent
Wildeman

(10) Patent No.: US 6,794,008 B2
(45) Date of Patent: Sep. 21, 2004

(54) DECORATIVE TEXTURIZED FABRIC

(75) Inventor: Martin Wildeman, Spartanburg, SC (US)

(73) Assignee: Tietex International, Ltd., Spartanburg, SC (US)

( * ) Notice: Subject to any disclaimer, the term of this patent is extended or adjusted under 35 U.S.C. 154(b) by 0 days.

(21) Appl. No.: 09/938,299

(22) Filed: Aug. 23, 2001

(65) Prior Publication Data

US 2002/0127936 A1 Sep. 12, 2002

Related U.S. Application Data

(60) Provisional application No. 60/227,236, filed on Aug. 23, 2000.

(51) Int. Cl.[7] ..... D06C 11/00; D06C 23/00; D04B 1/02; B32B 33/00

(52) U.S. Cl. ..... 428/89; 428/88; 428/91; 442/304; 442/312; 26/29 R; 26/30; 26/31

(58) Field of Search ..... 428/88, 89, 91; 442/304, 312; 26/29 R, 30, 31, 27–37; 66/194, 195

(56) References Cited

U.S. PATENT DOCUMENTS

| | | | | |
|---|---|---|---|---|
| 3,973,359 A | | 8/1976 | Spencer et al. | |
| 4,743,483 A | * | 5/1988 | Shimizu et al. | 428/89 |
| 5,557,950 A | | 9/1996 | Richards et al. | |
| 5,855,125 A | | 1/1999 | Lohmueller et al. | |
| 5,916,273 A | * | 6/1999 | Hepfinger | 66/194 |
| 5,920,971 A | | 7/1999 | Dumas | |
| 6,112,381 A | | 9/2000 | Dischler et al. | |
| 6,196,032 B1 | | 3/2001 | Rock et al. | |
| 6,199,410 B1 | | 3/2001 | Rock et al. | |
| 6,230,376 B1 | | 5/2001 | Dischler et al. | |
| 6,233,795 B1 | | 5/2001 | Dischler | |
| 6,260,247 B1 | | 7/2001 | Dischler et al. | |
| 6,269,525 B2 | | 8/2001 | Dischler et al. | |

OTHER PUBLICATIONS

Tortora, Phylis G. Understanding Textiles, Fourth Edition. Macmillan Publishing Company, New York. pp 354–355.*

* cited by examiner

*Primary Examiner*—Cheryl A. Juska
*Assistant Examiner*—Jenna-Leigh Befumo
(74) *Attorney, Agent, or Firm*—Dority & Manning, P.A.

(57) ABSTRACT

A decorative texturized fabric is provided. The fabric is produced from a fabric substrate that includes a yarn nappable from one side of the substrate. For instance, in one embodiment, the fabric substrate is a warp knitted fabric. According to the present invention, the fabric substrate is treated with a size composition according to a particular pattern. The fabric is then napped causing a nap to form on one side of the fabric where the size composition has not been applied. In this manner, a texturized pattern is formed into the fabric. After napping, the size composition can be removed from the fabric and the fabric can be dyed.

7 Claims, 2 Drawing Sheets

DECORATIVE TEXTURIZED FABRIC

RELATED APPLICATIONS

The present application is based on a Provisional Application filed on Aug. 23, 2000 having U.S. Ser. No. 60/227,236.

FIELD OF THE INVENTION

The present invention generally relates to decorative warp knitted fabrics suitable for use in home furnishings and in other related applications.

BACKGROUND OF THE INVENTION

Home furnishing fabrics, such as upholstery fabrics, are designed to not only be durable but have aesthetic appeal. In some applications, the fabrics are highly engineered in order to provide the fabric with a unique look or design. In general, such fabrics can have two types of designs. The first type is a design that is created with color, such as by using different colored yarns to weave the fabric.

The second type of fabric design is created by changing the texture of the fabric in a manner that creates visual pattern. For instance, in one embodiment, the texture of the fabric can be changed by changing the weave. For example, a jacquard weaving system is a system of weaving that utilizes a highly versatile pattern mechanism to permit the production of large, intricate designs. Jacquard weaving systems are very complicated and provide the ability to control the action of each warp thread during the passage of a single pick. Jacquard weaving is used to create tapestry, brocade, damask, and the like.

Unfortunately, fabrics produced on a jacquard weaving system and other similar fabrics containing textured patterns can be relatively expensive to produce. As such, a need currently exists for an inexpensive alternative to producing fabrics having a textured pattern. A need also exists for a textured pattern having a unique appearance in comparison to conventional fabrics.

SUMMARY OF THE INVENTION

The present invention is generally directed to a decorative fabric product and to a process for making the product. Fabric products made in accordance with the present invention have a distinctive and aesthetic textured pattern. The fabrics are well suited for uses in many diverse applications, such as being used in the home furnishings field.

In one embodiment, the process for producing the fabric product includes the steps of providing a fabric substrate having a face side and a back side. The fabric substrate contains a first yarn that is nappable from the face side of the fabric substrate. A size composition is applied to the face side of the fabric substrate according to a particular pattern such that the face side includes size treated areas and untreated areas. The size composition can include, for instance, a copolyester, a starch or a polyvinyl alcohol.

After the size composition is applied to the face side of the fabric, the face side is then napped using a napping device. During napping, the first yarn is napped in the untreated areas creating a fabric product having a textured pattern. If desired, once the fabric is napped, the size composition can be removed from the fabric substrate. For example, the fabric can be scoured in order to remove the size composition. Subsequently, the fabric can be dyed.

In one embodiment, the fabric substrate is a warp knitted fabric. The warp knitted fabric can contain at least two yarns. The first yarn can have a denier that is greater than the second yarn. The first yarn can predominantly form the face side of the fabric. For example, the first yarn can be a multifilament polyester yarn having a denier of from about 50 to about 200. The first yarn can be knitted into the fabric substrate in a manner that forms from about 14 to about 40 knitted rows per inch.

The second yarn, on the other hand, can be a monofilament polyester yarn. The second yarn can be knitted into the fabric substrate according to a chain stitch notation for providing integrity substrate.

The size composition can be applied to the face side of the fabric substrate in various manners. For instance, the size composition can be sprayed onto the fabric or printed onto the fabric. Printing the size composition onto the fabric allows the size composition to be applied to the fabric in particular discrete areas.

Besides the above process, the present invention is also directed to a fabric product having a textured surface. In one embodiment, the fabric product includes a warp knitted fabric containing at least a first yarn and a second yarn. The warp knitted fabric has a face surface and a back surface. The fabric is formed in a manner such that the face surface is predominantly comprised of the first yarn. For instance, the first yarn can be knitted into the fabric so as to form knitted rows visible from the face side. For example, the first yarn can form from about 14 to about 40 knitted rows per inch.

In accordance with the present invention, the warp knitted fabric is subjected to a napping process that selectively naps the first yarn from the face surface to form a textured pattern. In order to form the textured pattern, a size solution can be applied to the fabric prior to the napping process. The size solution prevents the first yarn from being napped from the surface thus allowing for a textured pattern to be formed.

Other features and aspects of the present invention are discussed in more detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
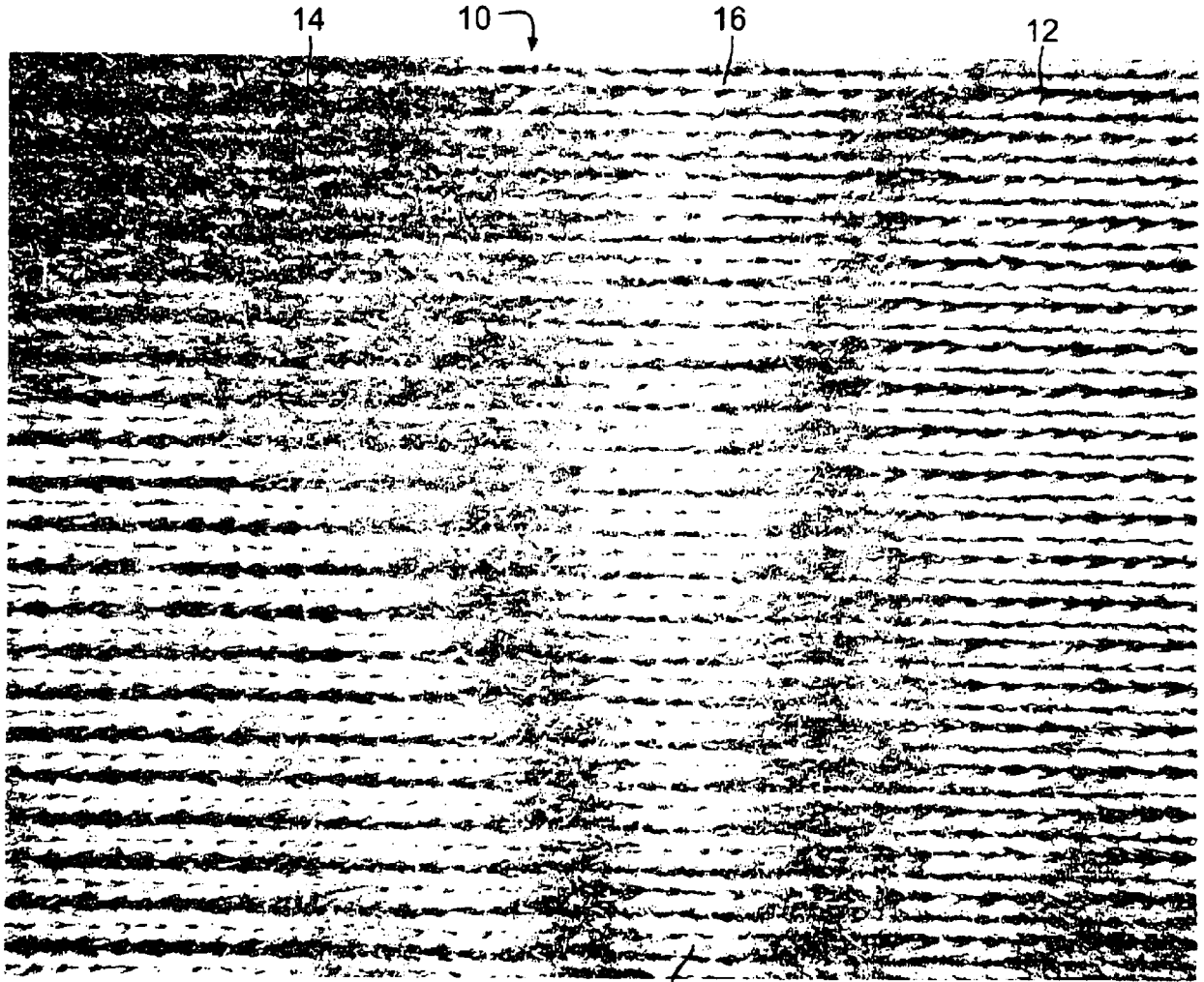
FIG. 1 is a magnified plan view of a fabric made in accordance with the present invention.

Repeat use of reference characters in the present specification and drawings is intended to represent same or analogous features of the invention.

DETAILED DESCRIPTION OF THE PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary constructions.

The present invention is generally directed to a decorative fabric having an aesthetic appearance. In particular, the fabric of the present invention includes a texturized pattern produced through a napping process. The fabric has many useful and diverse applications. For instance, the fabric is well suited to being used in the home furnishings field such as an upholstery fabric or as a fabric used to make curtains and the like. Of particular benefit, the fabric of the present invention is relatively inexpensive to produce in comparison to many conventionally made fabrics.

In general, the fabric of the present invention is a knitted fabric, such as a warp knitted fabric. Warp knitting refers to a type of knitting in which the yarns generally run lengthwise in the fabric. The yarns are prepared as warps on beams with one or more yarns for each needle. Examples of warp knitted fabrics include tricot, milanese, and raschel knitted fabrics. Warp knitted fabrics made in accordance with the present invention typically contain at least two yarns.

Although generally the present invention is directed to the use of a warp knitted fabric, it should be understood that a suitable woven fabric can also be used to construct the fabric product of the present invention. For a woven fabric to be suitable in the present invention, the woven fabric should be capable of withstanding a napping process and should include a yarn that is nappable from at least one side of the fabric. Since the use of warp knitted fabrics is preferred, however, the remainder of the following description will refer primarily to such fabrics.

In order to create a texturized pattern into the warp knitted fabric according to the present invention, a size composition is applied to the fabric according to a predetermined pattern. Once the size is applied, the fabric is then subjected to a napping process. Napping is a process that raises the surface fibers of the fabric by passing rapidly revolving cylinders covered with metal points or teasel burrs over the surface of the fabric. As used herein, napping is also intended to include brushing in which rotating brushes raise a nap on the fabric.

It has been discovered by the present inventor that when a fabric is napped according to the present invention, a nap is formed on the surface of the fabric where the size composition has not been applied. This process produces a textured pattern having an appealing look and feel.

One embodiment of a process made in accordance with the present invention will now be discussed in detail. As stated above, the fabric of the present invention is a warp knitted fabric constructed from at least two yarns. In other words, the warp knitted fabric can be referred to as a two bar fabric meaning that the fabric is made on a two bar knitting machine in which two yarn sheets are fed to two independent guide bars. It should be understood, however, that three or more bars may also be used to produce the fabric.

The basis weight of the warp knitted fabric can vary depending upon the particular application. For most applications, however, the basis weight of the fabric will be from about 2 osy to about 6 osy, such as from about 2.5 osy to about 3.5 osy.

The first yarn used to construct the fabric generally creates the face of the fabric. As used herein, the face of the fabric, the face side of the fabric, or the face surface of the fabric refers to the side of the fabric that includes a textured pattern made according to the present invention and is intended to be the decorative side of the fabric. The first yarn is knitted into the fabric in multiple rows. For instance, the first yarn can be knitted into the fabric using a bar having from about 14 needles per inch to about 40 needles per inch and, in one embodiment, having 32 needles per inch which forms a corresponding number of rows.

The course density of the first yarn can vary widely from about 20 courses per inch to about 60 courses per inch, and particularly from about 40 courses per inch to about 50 courses per inch.

The first yarn can be made from various materials, such as polyester. In one embodiment, the yarn can be a multifilament yarn having a denier of from about 50 to about 200. For example, in one embodiment, a 70 denier bright trilobal flat yarn can be used made from about 36 filaments.

The stitch that is used for the first yarn can also vary. In one embodiment, a 1, 0/3, 4 pattern notation can be used.

The second yarn used to form the warp knitted fabric generally forms the back of the fabric opposite the face side. In one embodiment, the second yarn can be chain stitched during formation of the fabric. For example, the chain stitch can have a 1, 0/1, 0 closed chain stitch notation.

Similar to the first yarn, various different yarns can be used as the second yarn to form the fabric without limitation. In one embodiment, the second yarn can be a monofilament polyester yarn. The yarn can have a denier of from about 10 to about 50, such as a denier of about 20.

Once the fabric is formed, a size composition is then applied to the fabric according to a predetermined pattern. For instance, the size composition can be printed onto the fabric. For example, in one embodiment, a Stork PD-3 rotary screen printer can be used. The size composition is applied to the fabric where it is desired for the fabric not to be napped.

Various designs can be applied to the fabric as desired. For instance, the size composition can be printed onto the fabric to form flowers, animals, designs, logos, and the like. Alternatively, the size composition can be applied to the fabric according to a geometric pattern or according to an abstract pattern that has the appearance of being random.

Any suitable size composition can be used in accordance with the present invention. More particularly, a size composition should be used that is capable of being printed and that will render a fabric resistant to napping. Examples of size compositions include copolyester compositions, starch compositions or polyvinyl alcohol compositions.

In one embodiment, Eastman WD copolyester size can be used. In order to facilitate printing of the size onto the fabric, a thickener or other agents can be added to the size.

In one particular embodiment, the size composition can include the following:

| Component | Weight % |
|---|---|
| Water | 44.50 |
| Eastman WD Size | 50.00 |
| Apex Defoamer PRT | 0.50 |
| Glotex Concentrate T1 | 5.00 |

After the size composition is applied to the fabric, the composition should be dried. For example, the fabric can be applied to a tenter frame and fed through the printing device. After printing, the fabric can then be processed through an oven at a temperature of about 390 degrees F. for a time sufficient for the size composition to dry.

After the size composition is applied to the fabric and dried, the fabric is then subjected to a napping process in accordance with the present invention. The napping device that contacts the face of the fabric can include burrs, such as teasel burrs, brushes, or a combination of both. For instance, a UNIPRO double action napper can be used which is manufactured by Gessner. During napping, the napping device raises the surface fibers of the fabric where the fabric has not been sized. The size composition, however, renders the fabric resistant to napping and allows the fabric to maintain a smooth surface.

Where the size composition has not been applied to the fabric, however, the napping process creates a downy surface or nap that provides contrast to the areas where the size has been applied.

After napping, the size is removed from the fabric and the fabric can be dyed if desired. For instance, in one embodiment, the fabric can be loaded onto a beam dye machine. Once wound onto a beam, hot water is pumped through the beam which removes the size. In one embodiment, a detergent, such as a non-ionic detergent can be added to the water pumped through the beam. The detergent can be added in an amount up to about 1 percent by weight, such as from about 0.2 percent to about 0.5 percent. The temperature of the water fed through the beam will vary depending upon the size composition. In one embodiment, the water is at a temperature of 190 degrees F.

Hot water is circulated through the beam until the size is completely removed. Once the size is removed, the hot water can be replaced with a dye and the fabric can be dyed.

After being scoured to remove the size and dyed, the fabric can be placed on a tenter frame and heat set. For example, in one embodiment, the fabric can be fed through an oven set at a temperature of about 380 degrees F.

Figure 2:
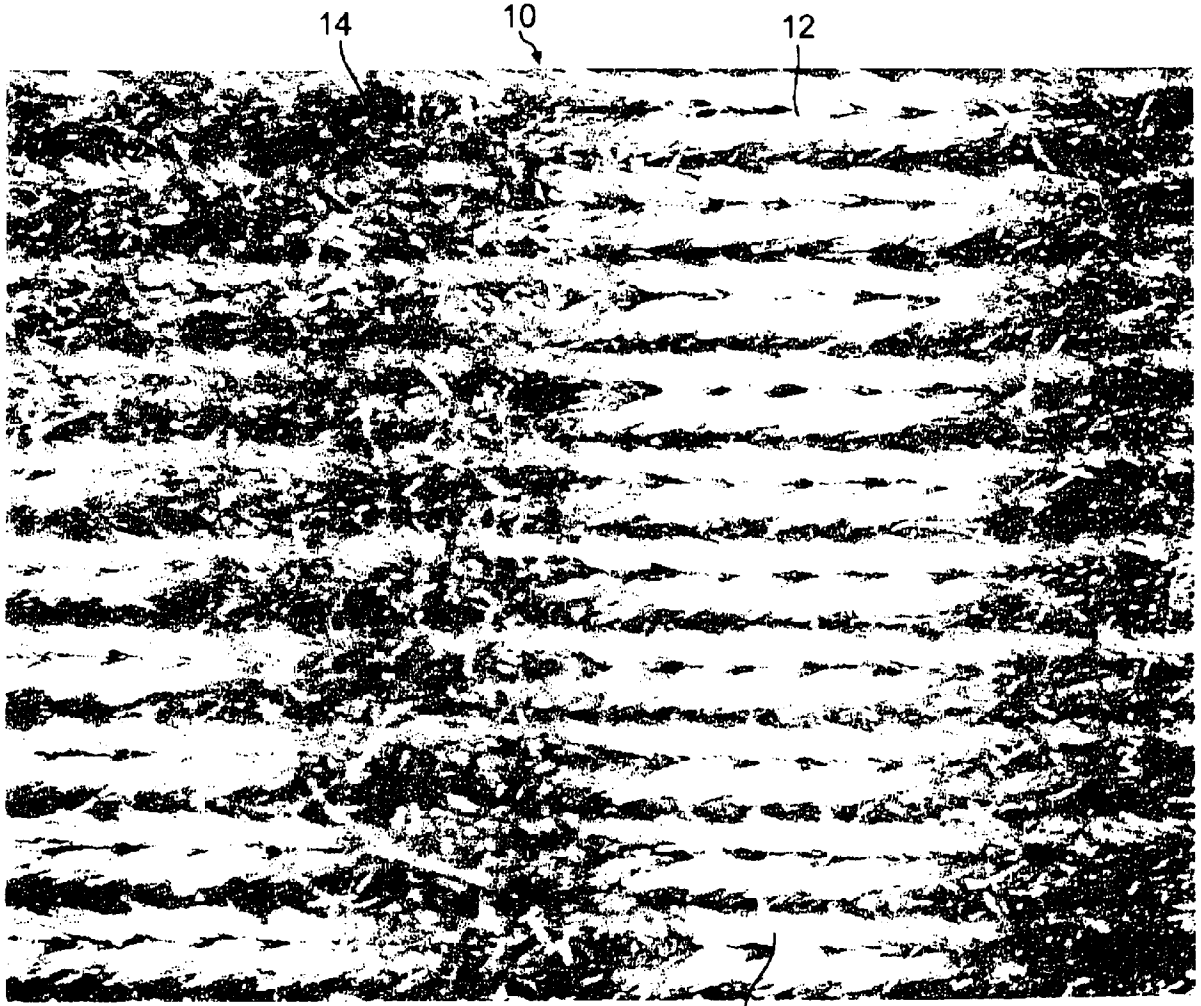
FIG. 2 is a further magnified plan view of the fabric shown in FIG. 1.

Referring to FIGS. 1 and 2, one embodiment of a fabric generally 10 made in accordance with the present invention is illustrated. As shown, fabric 10 is a warp knitted fabric containing rows of stitches 12 made from the first yarn.

In accordance with the present invention, the fabric further includes texturized or nap areas 14 and smooth areas 16. The smooth areas 16 are located where the size composition was applied. As shown, a striking contrast in texture is formed between the two areas. In this manner, many distinctive designs can be formed into the fabric for increasing the aesthetic appeal of the fabric.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed:

1. A fabric product having a textured surface comprising:

a warp knitted fabric containing at least a first yarn and a second yarn, said warp knitted fabric having a face surface and a back surface, said fabric being formed in a manner such that said face surface is predominantly comprised of said first yarn; and wherein a textured surface is formed on said warp knitted fabric according to a process comprising applying a size composition to the face surface of the fabric according to a pattern that includes size treated areas and untreated areas; napping the face surface such that the first yarn is napped in the untreated areas, the size composition, however, preventing the first yarn from being napped in the size treated areas; and removing the size composition after napping.

2. A fabric as defined in claim 1, wherein said warp knitted fabric comprises a tricot fabric, a milanese fabric, or a raschel fabric.

3. A fabric as defined in claim 1, wherein said first yarn has been knitted in a manner that forms from about 14 to about 40 knitted rows per inch appearing on the face surface of said warp knitted fabric.

4. A fabric as defined in claim 1, wherein said first yarn comprises a multifilament yarn.

5. A fabric as defined in claim 4, wherein said first yarn comprises a polyester yarn having a denier of from about 50 to about 200.

6. A fabric as defined in claim 1, wherein said second yarn forms chain stitches in said fabric, the second yarn comprising a monofilament yarn having a denier of at least about 10.

7. A fabric product having a textured surface comprising:

a warp knitted fabric containing at least a first yarn and a second yarn, the warp knitted fabric having a face surface and a back surface, the fabric being formed in a manner such that the face surface is predominately comprised of the first yarn, the first yarn comprising a multifilament yarn having a denier of from about 50 to about 200, the first yarn having been knitted in a manner that forms from about 14 to about 40 knitted rows per inch appearing on the face surface of the warp knitted fabric, the second yarn generally forming the back surface of the warp knitted fabric, the second yarn comprising a monofilament yarn having a denier of from about 10 to about 50; and wherein a textured surface is formed on the warp knitted fabric according to a process comprising applying a size composition to the face surface of the fabric according to a pattern that includes size treated areas and untreated areas; napping the face surface such that the first yarn is napped in the untreated areas, the size composition, however, preventing the first yarn from being napped in the size treated areas; and removing the size composition after napping.

* * * * *